US011420453B2

(12) United States Patent
Kitamura

(10) Patent No.: US 11,420,453 B2
(45) Date of Patent: Aug. 23, 2022

(54) CONVEYANCE DEVICE AND LIQUID DISCHARGE APPARATUS

(71) Applicant: Masaki Kitamura, Tokyo (JP)

(72) Inventor: Masaki Kitamura, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 40 days.

(21) Appl. No.: 16/800,784

(22) Filed: Feb. 25, 2020

(65) Prior Publication Data

US 2020/0298595 A1 Sep. 24, 2020

(30) Foreign Application Priority Data

Mar. 18, 2019 (JP) ..... JP2019-050315
Jul. 31, 2019 (JP) ..... JP2019-140532

(51) Int. Cl.
*B41J 13/00* (2006.01)
*B41J 11/00* (2006.01)

(52) U.S. Cl.
CPC ..... *B41J 13/0009* (2013.01); *B41J 11/007* (2013.01)

(58) Field of Classification Search
CPC ... B65H 3/48; B65H 3/66; B65H 3/14; B65H 3/64; B65H 3/124; B41J 29/38; B41J 11/0015; B41J 11/0025; B41J 11/0045; B41J 11/02; B41J 11/007; B41J 11/04; B41J 13/0009; B41J 15/04; B41J 29/377
See application file for complete search history.

(56) References Cited

U.S. PATENT DOCUMENTS 6,427,941 B1 * 8/2002 Hikita ..... B65H 23/32 226/185
2015/0009262 A1 1/2015 Bell et al.
2015/0239690 A1 * 8/2015 Muir ..... B65H 5/066 271/3.22

FOREIGN PATENT DOCUMENTS

JP 6-032503 2/1994
JP 2001085496 A * 3/2001 ..... B65G 49/065
JP 2007-062850 3/2007
JP 2007-161387 6/2007
JP 2015-022836 2/2015
JP 2015-131705 7/2015
JP 2015-147679 8/2015
JP 2015-222375 12/2015

* cited by examiner

*Primary Examiner* — Jannelle M Lebron
(74) *Attorney, Agent, or Firm* — Duft & Bornsen, PC

(57) ABSTRACT

A conveyance device includes a support having a support face configured to support a conveyed object and a fluid introduction device disposed outside the support. The fluid introduction device is configured to introduce a fluid between the support face of the support and the conveyed object, to form a fluid layer for floating the conveyed object. The conveyance device further includes a conveyor configured to convey the conveyed object being floating from the support via the fluid layer.

11 Claims, 8 Drawing Sheets

CONVEYANCE DEVICE AND LIQUID DISCHARGE APPARATUS

CROSS-REFERENCE TO RELATED APPLICATIONS

This patent application is based on and claims priority pursuant to 35 U.S.C. § 119(a) to Japanese Patent Application Nos. 2019-050315, filed on Mar. 18, 2019, and 2019-140532, filed on Jul. 31, 2019, in the Japan Patent Office, the entire disclosure of each of which is hereby incorporated by reference herein.

BACKGROUND

Technical Field

Embodiments of present disclosure relate to a conveyance device and a liquid discharge apparatus.

Related Art

There are conveyance devices that convey an object while floating the object above a support.

SUMMARY

According to an embodiment of this disclosure, a conveyance device includes a support having a support face configured to support a conveyed object and a fluid introduction device disposed outside the support. The fluid introduction device is configured to introduce a fluid between the support face of the support and the conveyed object, to form a fluid layer for floating the conveyed object. The conveyance device further includes a conveyor configured to convey the conveyed object being floating from the support via the fluid layer.

According to another embodiment, a liquid discharge apparatus includes a liquid discharge head configured to discharge a liquid onto a conveyed object, a first driven rotator disposed upstream from the liquid discharge head in a conveyance direction of the conveyed object, a second driven rotator disposed downstream from the liquid discharge head in the conveyance direction, and a fluid introduction device disposed outside the first driven rotator and the second driven rotator. The first and second driven rollers are configured to rotate along with conveyance of the conveyed object. The fluid introduction device is configured to introduce a fluid between the first driven rotator and the conveyed object and between the second driven rotator and the conveyed object, to form a fluid layer for floating the conveyed object. The liquid discharge head is configured to discharge the liquid onto the conveyed object being floating from the first driven rotator and the second driven rotator via the fluid layer.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
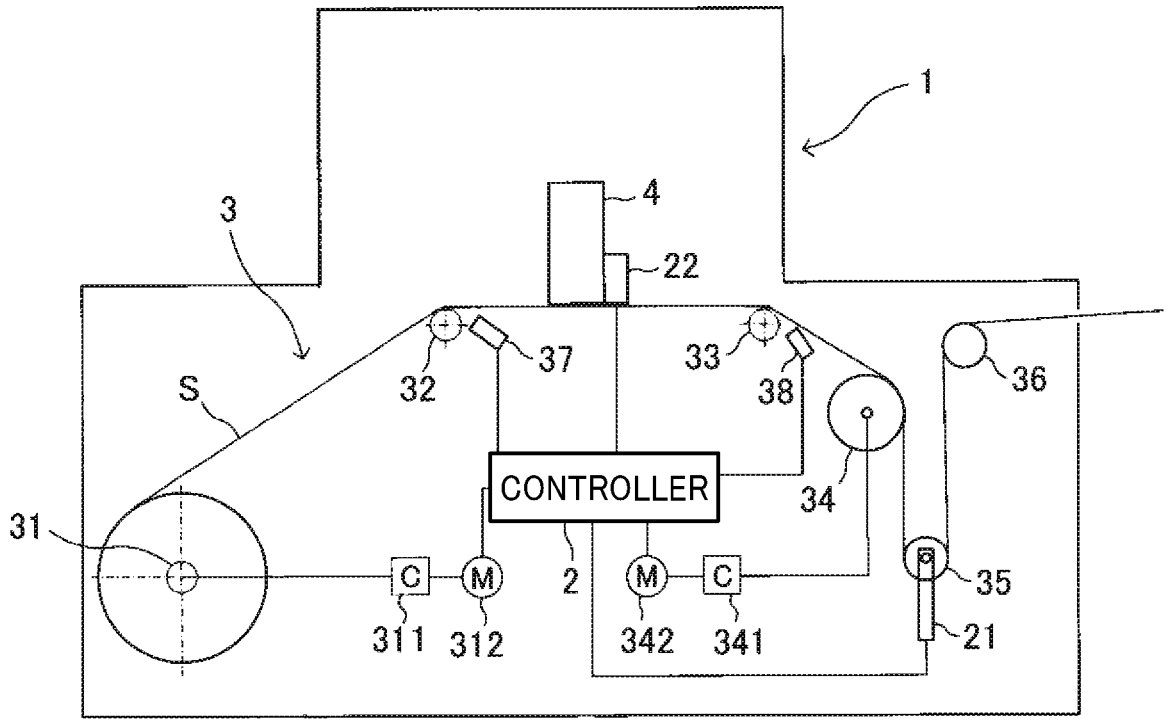
FIG. 1 is a diagram illustrating a schematic configuration of an inkjet recording apparatus according to an embodiment.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

Referring now to the drawings, wherein like reference numerals designate identical or corresponding parts throughout the several views thereof, embodiments of this disclosure are described. As used herein, the singular forms "a," "an," and "the" are intended to include the plural forms as well, unless the context clearly indicates otherwise.

Following describes an embodiment in which aspects of the present disclosure are applied to an inkjet recording apparatus as an image forming apparatus, which is a liquid discharge apparatus.

The present disclosure is not limited to the following exemplary embodiments.

Note that the term "recording sheet" on which an inkjet recording apparatus records an image signifies not only a sheet of paper but also a material to which ink droplets or other liquids can adhere. Examples of the "recording sheet" include an overhead projector (OHP) transparency, fabric, glass, and a substrate. The "recording sheet" is a synonym of a recorded medium, a recording medium, recording paper, and a recording paper sheet. The terms "image formation," "recording," "printing," and "image printing" are used herein as synonyms for one another.

Further, the term "inkjet recording apparatus" signifies both a serial inkjet recording apparatus and a line inkjet recording apparatus unless otherwise specified. The serial inkjet recording apparatus is an apparatus that moves a liquid discharge head mounted on a carriage in a main scanning direction perpendicular to a sheet feed direction, to perform recording. The line inkjet recording apparatus is an apparatus that uses a line head that includes a plurality of discharge ports (nozzles) arranged in rows to discharge droplets over substantially an entire width of a recording area. In the embodiments described below, a serial-type apparatus is employed, but the inkjet recording apparatus is not limited to the serial-type apparatus.

Liquid discharge heads are broadly classified into several types, according to the types of actuators to discharge ink droplets (liquid). For example, in a piezo liquid discharge head, a portion of a wall of a liquid chamber is constructed of a thin diaphragm, and a piezoelectric element as an electromechanical transducer element is disposed opposite the diaphragm. Voltage is applied to deform the piezoelectric element, and the deformation deforms the diaphragm. Then, the pressure in a pressure generation chamber is changed to discharge ink droplets. Further, in a bubble jet (registered trademark) liquid discharge head, a heat generating element is disposed in a liquid chamber. A heat generator is heated by energization, to generate bubbles. Ink droplets are discharged by the pressure of the bubbles. In an electrostatic liquid discharge head, a wall of a liquid chamber is constructed of a diaphragm, and a discrete electrode is disposed outside the liquid chamber and opposite the diaphragm. An electric field is generated between the diaphragm and the discrete electrode, to deform the diaphragm, thereby changing the internal pressure and volume of the liquid chamber. Thus, ink droplets are discharged from nozzles. In the present embodiment, an example of the piezo-type apparatus is described below. However, the liquid discharge head is not limited to the piezo-type apparatus.

A basic configuration of an inkjet recording apparatus according to the present embodiment is described.

FIG. 1 is a schematic diagram illustrating a configuration of the inkjet recording apparatus according to the present embodiment.

An inkjet recording apparatus 1 according to the present embodiment includes a controller 2, a sheet conveyance device 3, and an image forming device 4. For example, the controller 2 has a configuration similar to that of a general-purpose computer.

In the present embodiment, a sheet S is wound in a roll on a feed spool 31 of the sheet conveyance device 3 and thereby held. A portion of the sheet S unwound therefrom is stretched around and conveyed by a first driven roller 32 as a first driven rotator and a second driven roller 33 as a second driven rotator. The first driven roller 32 and the second driven roller 33 serve as supports of a conveyed object. The feed spool 31 is coupled to an unwinding motor 312, which is a direct current (DC) motor, via an unwinding powder clutch 311. The feed spool 31 is rotatable in a direction in which the sheet S is unwound by the drive force of the unwinding motor 312. Thus, the feed spool 31 serves as a conveyor.

The image forming device 4 is disposed opposite a portion of the sheet S stretched between the first driven roller 32 and the second driven roller 33. The image forming device 4 discharges ink from the liquid discharge head to the portion of the sheet stretched with a predetermined tension, to form an image. The portion of the sheet on which the image has been formed is wound around conveyance rollers 34 and 36 and a tension roller 35 and conveyed to a post-processing apparatus such as a drying device and a sheet cutting device. The conveyance roller 34 is coupled, via a conveyance powder clutch 341, to a conveyance motor 342 constructed of a DC motor, and is rotatable in a direction in which the sheet S is conveyed by the drive force of the conveyance motor 342.

Figure 2:
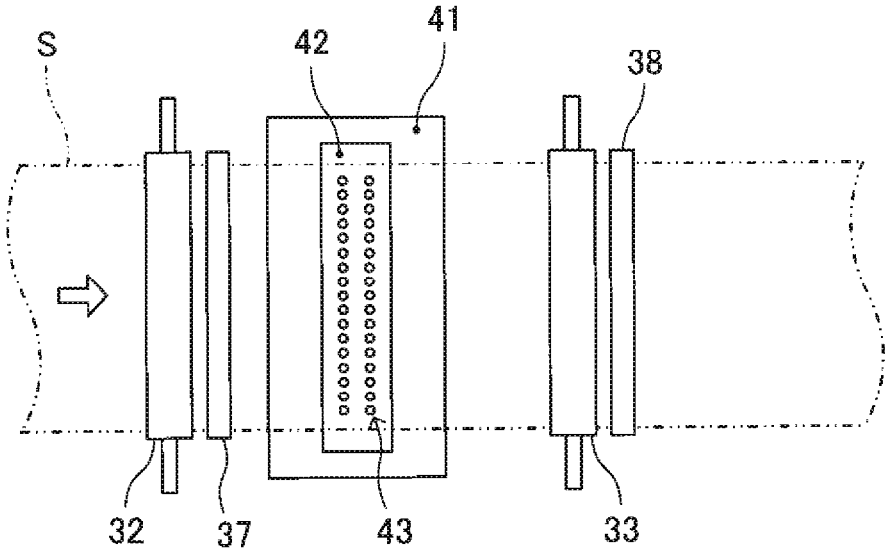
FIG. 2 is a bottom view illustrating an image forming device of the inkjet recording apparatus illustrated in FIG. 1.

FIG. 2 is a bottom view illustrating the image forming device 4 of the inkjet recording apparatus according to the present embodiment.

The inkjet recording apparatus according to the present embodiment is a line inkjet recording apparatus, and includes a head unit 41. The head unit 41 includes a liquid discharge head 42 (a liquid discharge device). The liquid discharge head 42 includes rows of nozzles 43 (discharge orifices). The nozzle rows extend in a sub-scanning direction (longitudinal direction of the liquid discharge head 42), which is perpendicular to the main scanning direction. The liquid discharge head 42 is disposed with the liquid discharge direction downward.

The sheet S unwound from the feed spool 31 is conveyed in the sub-scanning direction while being stretched between the first driven roller 32 and the second driven roller 33. While a carriage 433 moves, in accordance with an image signal, the liquid discharge head 42 of the head unit 41 is driven to discharge ink onto the portion of the sheet S stretched between the first driven roller 32 and the second driven roller 33. Thus, an image for one line is recorded. Then, the sheet S is fed by a predetermined distance, and another line of the image is recorded.

In general, in inkjet recording apparatuses, when the distance (ink discharge distance) between the liquid discharge head 42 and the sheet S fluctuates, the ink landing position accuracy deteriorates, and the image quality deteriorates. In particular, the first driven roller 32 and the second driven roller 33 on which the sheet S is stretched generally have rotational runout depending on the mechanical accuracy, the mounting accuracy, and the like. Then, the distance from the center of rotation of each of the rollers 32 and 33 to the roller face (e.g., a face 330 in FIGS. 3 and 4) around which the sheet S is wound (contacts) varies. The face 330 serves as a support face. Therefore, when the first driven roller 32 and the second driven roller 33 rotate as the sheet S is conveyed, the position of the roller face around which the sheet S is wound fluctuates. Then, the sheet S flutters in the portion stretched between the rollers 32 and 33. As a result, that portion of the sheet is temporally displaced in the direction of contact and separation (up and down direction) with respect to the liquid discharge head 42. Then, the ink discharge distance fluctuates, and the image quality is degraded.

To solve such an inconvenience, conveying the sheet S without rotating the first driven roller 32 and the second driven roller 33 is effective. In a configuration in which the first driven roller 32 and the second driven roller 33 are replaced with irrotational supports that do not rotate, rotational runout can be avoided. During the sheet conveyance, the position of the support face around which the sheet S is wound does not fluctuate. Then, the distance (ink discharge distance) between the portion of the sheet stretched between these supports and the liquid discharge head 42 can be kept constant. However, an inconvenience remains if simply replacing the first driven roller 32 and the second driven roller 33 with the members that do not rotate during the sheet conveyance. Since the sheet S constantly slides on the surfaces of the irrotational supports during the sheet conveyance, the resistance against conveyance increases. In addition, when the frictional force differs between the irrotational supports, the tension of the portion of the sheet stretched therebetween fluctuates, resulting in fluctuations in the ink discharge distance. Then, the ink landing position accuracy may deteriorate.

In view of the foregoing, in the present embodiment, after a predetermined time has elapsed from the start of conveyance, the first driven roller 32 and the second driven roller 33 stop rotating, and a fluid layer is formed between the sheet S and the roller faces (support faces). Thus, the sheet S is prevented from directly contacting the roller faces. Accordingly, even when the first driven roller 32 and the second driven roller 33 stop rotating during sheet conveyance, the sheet S does not slide on the surfaces of the first driven roller 32 and the second driven roller 33. Therefore, the resistance against conveyance is small, thereby suppressing fluctuations in the tension of the portion of the sheet stretched between the first driven roller 32 and the second driven roller 33.

However, formation of such a fluid layer requires means for introducing a fluid between the surfaces (support faces) of the first driven roller 32 and the second driven roller 33 and the sheet S. For example, the fluid may be introduced as follows. Fluid openings are formed in the surfaces of the first driven roller 32 and the second driven roller 33, and a fluid introduction device blows out the fluid from inside the rollers through the fluid openings, to introduce the fluid between the roller faces and the sheet S. However, the processing cost increases because of the processing of the fluid openings.

Therefore, the present embodiment employs the following configuration. The fluid openings are not formed in the surfaces of the first driven roller 32 and the second driven roller 33, and a fluid introduction device introduces the fluid from outside the first driven roller 32 and the second driven roller 33, to form the fluid layer between the roller faces and the sheet S. In the following description, air is blown out as a fluid to form an air layer (a fluid layer) between the roller faces and the sheet S. However, the fluid other than air can be used.

The inkjet recording apparatus 1 according to the present embodiment includes air supply devices 37 and 38 as the fluid introduction device. As illustrated in FIG. 1, the air supply devices 37 and 38 are respectively disposed to blow air between the roller face and the sheet S from the downstream side of the first driven roller 32 and the second driven roller 33 in the sheet conveyance direction. The air supply devices 37 and 38 are configured to supply air substantially uniformly to the contact portion between the roller face and the sheet S entirely in the sheet width direction. The air supply devices 37 and 38 can have any air blowing configuration such as an air compressor, and the operation is controlled by the controller 2.

When the sheet conveyance device 3 starts the sheet conveyance operation, the controller 2 starts driving the unwinding motor 312 and the conveyance motor 342, and the sheet S is unwound from the feed spool 31. As a result, the wound sheet portion moves in the sub-scanning direction (sheet conveyance direction), and the first driven roller 32 and the second driven roller 33 are rotated along with the sheet S. Accordingly, the sheet S is conveyed without sliding on the surfaces of the first driven roller 32 and the second driven roller 33, and the resistance against sheet conveyance can be small.

Meanwhile, as the sheet conveyance is started, the controller 2 causes the air supply devices 37 and 38 to supply air between the surfaces of the first driven roller 32 and the second driven roller 33 and the sheet S. Thus, air is sent between the sheet S and the surfaces of the first driven roller 32 and the second driven roller 33 that are rotated along with the movement of the sheet S. Then, the contact area between the roller face and the sheet S gradually decreases. As a result, the frictional force between the roller face and the sheet S decreases, and the first driven roller 32 and the second driven roller 33 no longer follows the movement of the sheet S. Then, the rotation speed gradually decreases. As the air supply devices 37 and 38 keep supplying air, a sufficient air layer is stably formed between the roller face and the sheet S. In such a steady state, the first driven roller 32 and the second driven roller 33 completely stop rotating. In that state, the conveyance of the sheet S is continued.

After the first driven roller 32 and the second driven roller 33 enter such an irrotational state, the image forming device 4 starts the image forming operation. The liquid discharge head 42 discharges ink to the portion of the sheet S between the first driven roller 32 and the second driven roller 33, to form an image.

When the first driven roller 32 and the second driven roller 33 are irrotational, the portion of the sheet S stretched between the first and second driven rollers 32 and 33, that is, the sheet portion opposite the liquid discharge head 42 of the image forming device 4, does not flutter due to the rotational runout of the first and second driven rollers 32 and 33. Accordingly, the ink discharge distance does not fluctuate, and the ink landing position accuracy is improved.

Moreover, in the present embodiment, since the air layer is interposed between the surfaces of the irrotational first and second driven rollers 32 and 33 and the sheet S, the sheet S is conveyed without sliding on the surfaces of the first and the second driven rollers 32 and 33. Accordingly, the resistance against conveyance is small, and the tension of the portion of the sheet S stretched therebetween hardly fluctuates.

Further, the air supply devices 37 and 38 according to the present embodiment introduce air from outside the first driven roller 32 and the second driven roller 33 to form an air layer between the roller face and the sheet S. Therefore, an air layer can be formed between the roller face and the sheet S even if the surfaces of the first driven roller 32 and the second driven roller 33 have no fluid openings. Therefore, the first driven roller 32 and the second driven roller 33 can have a standard roller structure without the fluid openings, and the processing cost for processing the fluid opening becomes unnecessary, resulting in cost reduction.

In the present embodiment, a tension sensor 21 is provided to detect the tension of the sheet S. The tension sensor 21 is mounted on a roller shaft of a tension roller 35 around which the sheet S is wound. The tension information of the sheet S detected by the tension sensor 21 is transmitted to the controller 2. The controller 2 controls the air supply devices 37 and 38 according to the tension information from the tension sensor 21.

As the tension of the sheet S increases, the force for pressing the sheet S against the roller face increases. Then, a greater amount of air should be supplied in order to stably form an air layer between the roller face and the sheet S. On the other hand, if excessive air is supplied between the roller face and the sheet S when the tension of the sheet S is low, the sheet S may flutter due to the air supply, which may result in fluctuations in the ink discharge distance.

Therefore, in the present embodiment, as the sheet tension indicated by the tension information from the tension sensor 21 becomes higher, the controller 2 increases the air supply amount per unit time supplied from the air supply devices 37 and 38. Similarly, as the sheet tension indicated by the tension information from the tension sensor 21 becomes lower, the controller 2 decreases the air supply amount per unit time supplied from the air supply devices 37 and 38. With such control, even if the tension of the sheet S fluctuates, an appropriate amount of air can be supplied according to the sheet tension at that time. As a result, even when the tension of the sheet S increases, an air layer can be formed stably between the roller face and the sheet S. Additionally, even when the tension of the sheet S decreases, the fluttering of the sheet S due to the supplied air can be prevented.

In the present embodiment, the behavior of the sheet S is detected with a behavior detector. Specifically, a displacement sensor 22 is provided to detect the displacement of the portion of the sheet S stretched between the first driven roller 32 and the second driven roller 33, that is, the sheet portion opposite the liquid discharge head 42 of the image forming device 4. The displacement sensor 22 detects the displacement of the sheet S in the direction in which the sheet S approaches and draws away from the liquid discharge head 42. The displacement sensor 22 is supported by the housing of the image forming device 4. The displacement sensor 22 transmits a change in the distance (sheet behavior information) between a sensing portion of the displacement sensor 22 and the sheet portion facing the sensing portion to the controller 2. Then, the controller 2 controls the air supply devices 37 and 38 according to the sheet behavior information from the displacement sensor 22.

Specifically, for example, when the sheet behavior information indicates a periodic sheet displacement, the controller 2 increases the amount per unit time of air supplied from the air supply devices 37 and 38. When such a periodic sheet displacement is detected, conceivably, the air supply amount is insufficient, and a sufficient air layer is not formed, causing the first driven roller 32 and the second driven roller 33 to move along with the movement of the sheet S. By performing the above-described control when a periodic sheet displacement is detected, a sufficient air layer can be formed. Accordingly, the first driven roller 32 and the second driven roller 33 can be kept irrotational stationary state, and fluctuations of the ink discharge distance can be minimized.

Further, for example, when the sheet behavior information indicates minute sheet displacement, the controller 2 reduces the amount per unit time of air supplied from the air supply devices 37 and 38. When such minute sheet displacement is detected, conceivably, the sheet S is fluttering due to an excessive air supply. By performing the above-described control when a minute sheet displacement is detected, excessive air supply is prevented. Then, fluttering of the sheet S due to air supply is inhibited, and fluctuations in the ink discharge distance can be minimized.

The air supply devices 37 and 38 according to the present embodiment blow air between the roller face and the sheet S from the downstream side of the first driven roller 32 and the second driven roller 33 in the sheet conveyance direction. Alternatively, air can be blown from the upstream side in the sheet conveyance direction.

Figure 3:
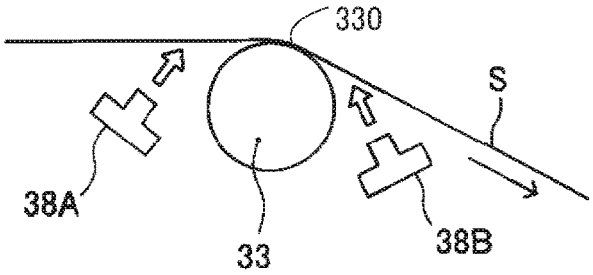
FIG. 3 is a schematic view illustrating an example in which air supply devices are provided on both sides of a second driven roller in a sheet conveyance direction, in the inkjet recording apparatus.

FIG. 3 illustrates another alternative structure. For example, air supply devices 38A and 38B are disposed on the upstream side and the downstream side of the second driven roller 33 in the sheet conveyance direction, to blow air between the face 330 of the second driven roller 33 and the sheet S from both sides in the sheet conveyance direction.

Figure 4:
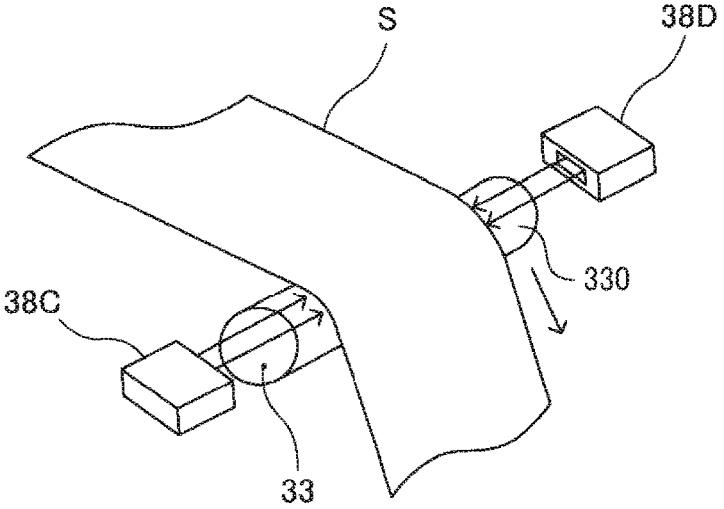
FIG. 4 is a perspective view illustrating an example in which air is blown between a face of the second driven roller and a sheet from end sides of the second driven roller toward.

FIG. 4 illustrates another alternative structure. For example, air supply devices 38C and 38D are disposed outward the second driven roller 33 in the axial direction of the driven roller 33, that is, farther from the axial center of the second driven roller 33 than the end of the second driven roller 33 in the axial direction. The air supply devices 38C and 38D blow air between the face 330 of the second driven roller 33 and the sheet S from the end sides in the roller axial direction. In other words, the air supply devices 38C and 38D blow air toward the second driven roller 33 as the support in the direction perpendicular to the conveyance direction of the sheet S.

Further, in the present embodiment, at the beginning of the sheet conveyance, a sufficient air layer is not yet formed between the first driven roller 32 and the sheet S and between the second driven roller 33 and the sheet S. Accordingly, the first driven roller 32 and the second driven roller 33 rotate along with (are rotated by) the sheet conveyance, thereby reducing the resistance against conveyance. When an air layer is formed and the first driven roller 32 and the second driven roller 33 stop rotating, the sheet S does not flutter due to the rotational runout of the driven rollers 32 and 33. Then, the ink discharge distance does not fluctuate, and the ink landing position accuracy is improved. In order to form high-precision images, it is necessary to start image formation after the first driven roller 32 and the second driven roller 33 stop rotating. Therefore, preferably, the first driven roller 32 and the second driven roller 33 stop rotating as soon as possible.

Figure 5:
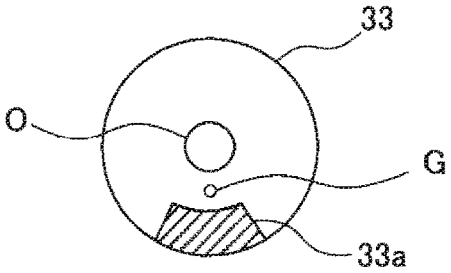
FIG. 5 is a schematic view illustrating an example in which a weight is provided in a portion of the second driven roller in a circumferential direction of the second driven roller.
Figure 6:
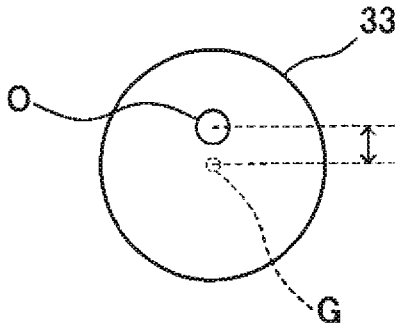
FIG. 6 is a schematic diagram illustrating an example in which the rotation axis of the second driven roller is eccentric.

In view of the foregoing, in the present embodiment, the centers of gravity of the first driven roller 32 and the second driven roller 33 can be off the center of rotation thereof. Specifically, for example, as illustrated in FIG. 5, a weight 33*a* is provided on a portion of the second driven roller 33 in the circumferential direction (direction of arc) to divert a center of gravity G of the second driven roller 33 from a rotation center O. Alternatively, for example, as illustrated in FIG. 6, the rotation axis of the second driven roller 33 is made eccentric, thereby diverting the center of gravity G of the second driven roller 33 from the rotation center O. Such a configuration can shorten the time to rotation stop of the first driven roller 32 and the second driven roller 33, which have been rotated by the movement of the sheet S, due to formation of an air layer.

When a sufficient air layer is stably formed between the surfaces of the first driven roller 32 and the second driven roller 33 and the sheet S by the air supplied from the air supply devices 37 and 38, the first driven roller 32 and the second driven roller 33 become the stationary state. To attain the stationary state, it is important to inhibit the air from escaping from between the roller face and the sheet S, thereby increasing the air pressure in that area. Particularly, when the tension of the sheet S is high, the contact pressure between the roller face and the sheet S is high. Accordingly, to stably form the air layer therebetween, the air is inhibited from escaping from the area.

Figure 7:
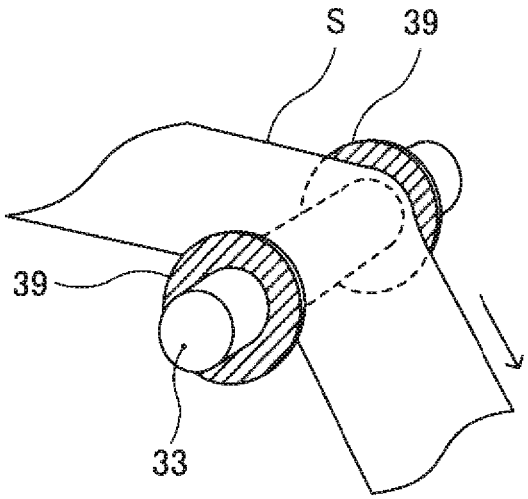
FIG. 7 is a perspective view illustrating an example in which outflow stopper plates are disposed at axial ends (ends in a sheet width direction) of the second driven roller.
Figure 8:
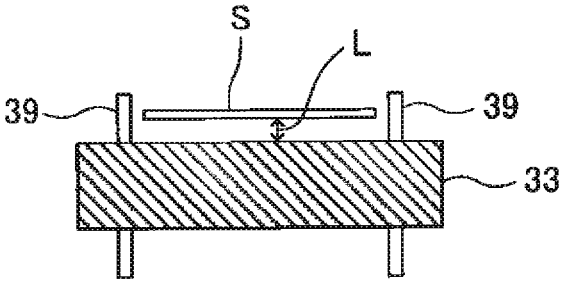
FIG. 8 is a cross-sectional view taken along the rotation axis of the second driven roller in FIG. 7.

Therefore, for example, as illustrated in FIGS. 7 and 8, outflow stopper plates 39 can be provided, as outflow stoppers, at ends (ends in the sheet width direction) of the second driven roller 33 in the axial direction. The outflow stopper plates 39 prevent the air introduced between the roller face and the sheet S from flowing out in the sheet width direction. Then, the sheet S floats by a distance L above the second driven roller 33. The outflow stopper plates 39 illustrated in FIGS. 7 and 8 are formed on the surface of the second driven roller 33 and integral with the second driven roller 33. Alternatively, the outflow stopper plates 39 can be separate from the second driven roller 33. Such a configuration can increase the pressure of the air layer between the roller face and the sheet S, and stably form the air layer even when the tension of the sheet S is set high.

Next, a description is given of a modified configuration of the support of the sheet S (hereinafter referred to as "Variation 1").

The first driven roller 32 and the second driven roller 33, which are the supports of the sheet S in the above-described embodiment, are rotators (followers) and rotate along with the movement of the sheet S until the air layer is formed between the roller face and the sheet S. Such a configuration is advantageous, for example, in a situation where, after the air layer is formed and the image forming operation is started, the air layer between the roller face and the sheet S is collapsed by fluctuations in the tension of the sheet S, and the sheet S contacts the roller face. Even in such a situation, since the first driven roller 32 and the second driven roller 33 rotate along with the sheet S, a sharp increase in the resistance against conveyance can be avoided. Thus, the image forming operation can be continued. Further, for example, when the support is an irrotational body, a large resistance against conveyance occurs due to the static friction force at the start of the conveyance of the sheet S. By contrast, the support being a rotator can rotate along with the movement of the sheet S. Then, advantageously, the resistance against conveyance can be suppressed from the start of conveyance of the sheet S.

On the other hand, when the support is an irrotational body, the degree of freedom in layout can be higher and required space can be reduced compared with a case where the support is a rotator. Therefore, as Variation 1, a description is given of an example in which the support is an irrotational body. In the following example, a conveyance guide 133 which is an irrotational body is used instead of the second driven roller 33, but the first driven roller 32 can be replaced with an irrotational body similarly.

Figure 9:
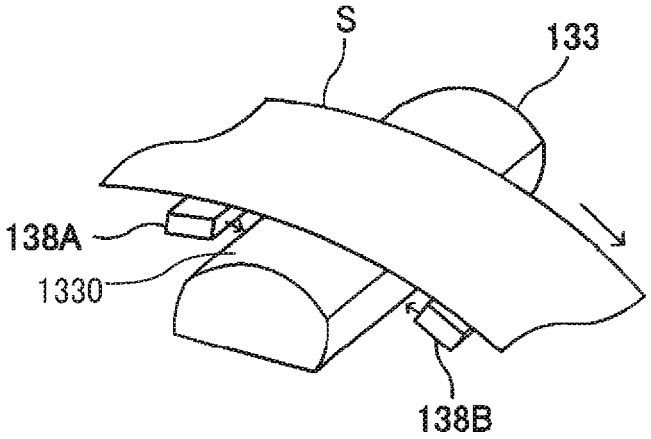
FIG. 9 is a perspective view illustrating a configuration in which an irrotational conveyance guide is used instead of the second driven roller, according to Variation 1.

FIG. 9 is a perspective view illustrating a configuration of Variation 1 in which the conveyance guide 133 that is an irrotational body is used instead of the above-described second driven roller 33.

In Variation 1, the conveyance guide 133 has a curved face 1330 in the portion around which the sheet S is wound, similar to the second driven roller 33, and the sheet S is wound along the curved face 1330. In other words, the conveyance guide 133 according to Variation 1 is constructed of only a portion (around which the sheet S is wound) of the second driven roller 33 in the circumferential direction (arc direction), and is smaller than the second driven roller 33.

In Variation 1, when the sheet conveyance device 3 starts the sheet conveyance, the controller 2 causes the air supply devices 138A and 138B to blow out the air to the contact portion between the curved face 1330 of the conveyance guide 133 and the sheet S. The air is supplied between the curved face 1330 of the conveyance guide 133 and the sheet S, and an air layer is formed therebetween. Then, the controller 2 starts driving the unwinding motor 312 and the conveyance motor 342, and the sheet S is unwound from the feed spool 31. As a result, the wound portion of the sheet S moves in the sub-scanning direction (sheet conveyance direction). In Variation 1, at this time, the air layer is already formed between the curved face 1330 of the conveyance guide 133 and the sheet S, and the sheet S is conveyed without sliding on the curved face 1330 of the conveyance guide 133. Thus, the sheet S can be conveyed with small resistance against conveyance.

In Variation 1, since the conveyance guide 133 is an irrotational body, the portion of the sheet S facing the liquid discharge head 42 of the image forming device 4 does not fluctuate due to rotational runout. Accordingly, the ink discharge distance does not fluctuate, and the ink landing position accuracy is improved.

The curved face 1330 of the conveyance guide 133 preferably has a low friction coefficient with respect to the sheet S. Such a configuration is advantageous even when the following situation occurs after the image forming operation is started. Even when the air layer between the curved face 1330 of the conveyance guide 133 and the sheet S collapses due to fluctuations in the tension of the sheet S, and the sheet S contacts the curved face 1330 of the conveyance guide 133, a sharp increase in the resistance against conveyance is prevented. Then, the image forming operation can be continued.

Figure 10:
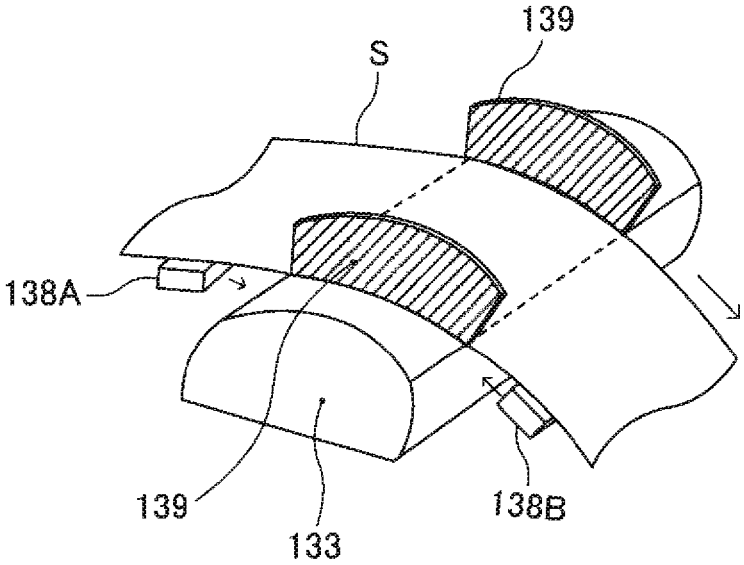
FIG. 10 is a perspective view illustrating an example in which outflow stopper plates are disposed at the axial ends (ends in a sheet width direction) of the second driven roller.

As illustrated in FIG. 10, in Variation 1, the outflow stopper plates 139, as the outflow stoppers, can be disposed at ends of the conveyance guide 133 in the sheet width direction, in order to prevent the air introduced between the curved face 1330 of the conveyance guide 133 and the sheet S from flowing out in the sheet width direction.

In Variation 1, the sheet conveyance is started after the air layer is formed by the air supply. Alternatively, the sheet conveyance and the air supply can be started at the same time, or the sheet conveyance can be started earlier than the air supply. However, when the sheet conveyance is started before the air layer is formed, a large resistance against conveyance occurs due to the static friction force at the start of the conveyance of the sheet S. Therefore, the curved face 1330 of the conveyance guide 133 preferably has a low friction coefficient with respect to the sheet S.

Next, a description is given of another modified example of the air supply device according to the above-described embodiment (hereinafter referred to as "Variation 2").

In the configuration in which air for forming a fluid layer is formed between the surfaces of the first driven roller 32 and the second driven roller 33 and the sheet as in the above-described embodiment, the roller faces are contactless with the sheet. Accordingly, the sheet is likely to meander or deviate to one side. More specifically, in a typical structure in which a sheet is in contact with a roller face and conveyed thereon, there can arise force to displace the sheet in the direction (sheet width direction) perpendicular to the conveyance direction. However, against such force, the frictional force between the roller face and the sheet acts as drag, thereby inhibiting the sheet from meandering and deviating. By contrast, in a configuration in which the roller face is contactless with the sheet, the drag due to such frictional force does not act. Then, the sheet is likely to meander or deviate.

Figure 11:
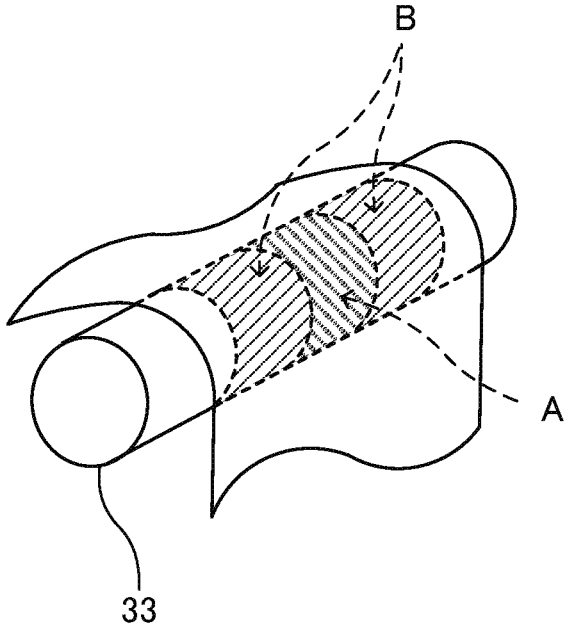
FIG. 11 is a schematic perspective view illustrating a state in which the flow rate in a center area of the sheet in the sheet width direction is smaller than the flow rate in end areas in the sheet width direction, according to Variation 2.

In Variation 2, as illustrated in FIG. 11, the air supply device blows the air in a smaller flow rate to a center area A of the sheet S in the sheet width direction than the flow rate in end areas B. In such a state, in the fluid layer between the sheet S and the roller face, an internal pressure differs between the center area A and the end areas B in the sheet width direction. This configuration exerts a force to move the end areas B of the sheet S toward the center in the sheet width direction. Accordingly, the meandering and deviation of the sheet S can be suppressed autonomously.

An example of the air supply device according to Variation 2 is the above-described configuration illustrated in FIG. 4.

The configuration illustrated in FIG. 4, the air supply devices 38C and 38D are disposed outward the second driven roller 33 in the axial direction thereof, to blow air between the roller face and the sheet S from the end sides in the roller axial direction. With this configuration, the air flow rate in the center area A of the sheet S is smaller than the air flow rate in the end areas B of the sheet S in the sheet width direction. Therefore, the meandering and deviation of the sheet S are autonomously suppressed by the internal pressure difference. Moreover, in the example illustrated in FIG. 4, since the air is blown to the sheet S from both sides of the sheet S, the blown air exerts force for moving the sheet S toward the center in the sheet width direction, and the effect of autonomous suppression of meandering and deviation of the sheet S is high.

Figure 12:
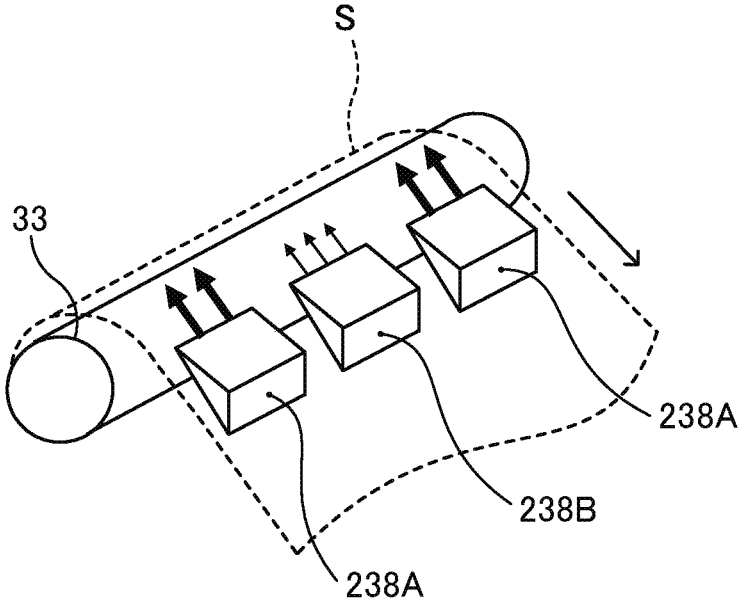
FIG. 12 is a schematic view of another example of the air supply device according to Variation 2.

FIG. 12 is a schematic view of another example of the air supply device according to Variation 2.

In the example illustrated in FIG. 12, on the downstream side of the second driven roller 33 in the sheet conveyance direction, air supply devices 238A having a larger flow rate are disposed at both ends in the sheet width direction, and an air supply device 238B having a smaller flow rate is disposed at the center in the sheet width direction. Also in this configuration, the air flow rate in the center area A of the sheet S is smaller than the air flow rate in the end areas B of the sheet S in the sheet width direction. Therefore, the meandering and deviation of the sheet S are autonomously suppressed by the internal pressure difference.

Figure 13:
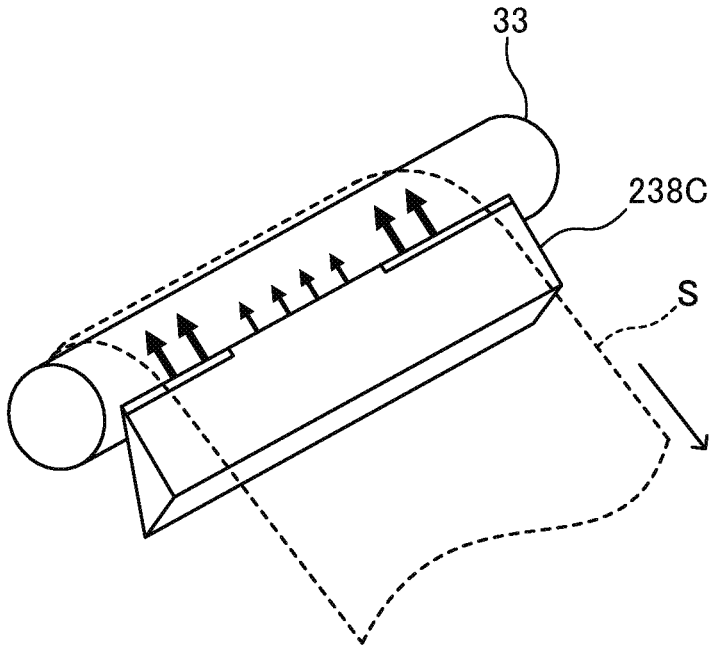
FIG. 13 is a schematic view of yet another example of the air supply device according to Variation 2.

FIG. 13 is a schematic view of yet another example of the air supply device according to Variation 2.

In the example illustrated in FIG. 13, the opening area of the air outlet of the air supply device 238C downstream from the second driven roller 33 in the sheet conveyance direction is changed so that the air flow rate in the center area A of the sheet S is smaller than the flow rate of air blown to the end areas B of the sheet S in the sheet width direction. Also in this configuration, the meandering and deviation of the sheet S are autonomously suppressed by the internal pressure difference.

Figure 14:
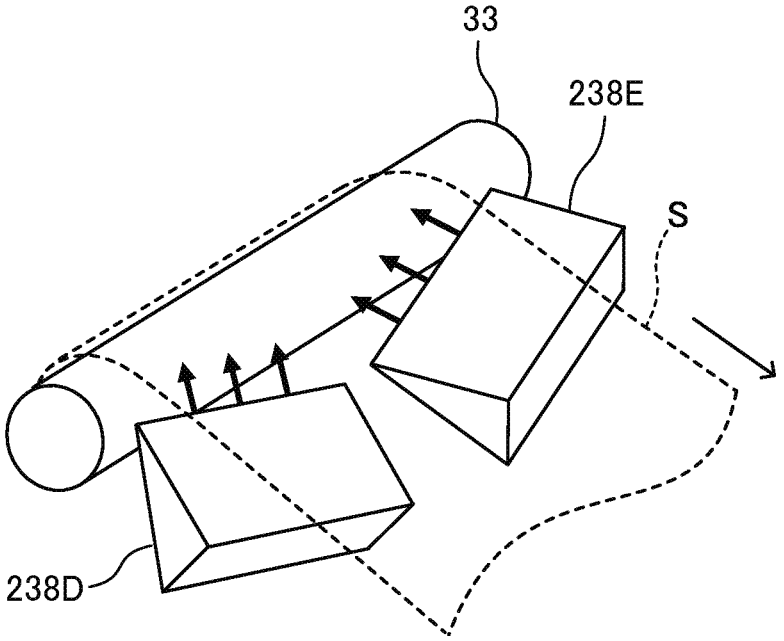
FIG. 14 is a schematic view of yet another example of the air supply device according to Variation 2.

FIG. 14 is a schematic view of yet another example of the air supply device according to Variation 2.

In the example illustrated in FIG. 14, on the downstream side of the second driven roller 33 in the sheet conveyance direction, air supply devices 238D and 238E having the same flow rate are disposed at both ends of the second driven roller 33 in the sheet width direction. The air supply devices 238D and 238E direct air toward the axial center obliquely. The air outlets of the air supply devices 238D and 238E are oblique to the axial direction of the second driven roller 33. In this configuration, near the center in the sheet width direction, the air introduced from the air supply device 238D collides with the air introduced from the air supply device 238E, and the flow rate decreases. Therefore, the air flow rate in the center area A of the sheet S is smaller than the air flow rate in the end areas B of the sheet S. Therefore, the meandering and deviation of the sheet S are autonomously suppressed by the internal pressure difference. Further, in the example illustrated in FIG. 14, the direction of airflow along the surface of the sheet S is oblique to the axial direction of the second driven roller 33 and orienting toward the center in the sheet width direction. Accordingly, the airflow exerts force for moving the sheet S toward the center in the sheet width direction. Therefore, the effect of autonomously suppressing the meandering and deviation of the sheet S is high.

Figure 15:
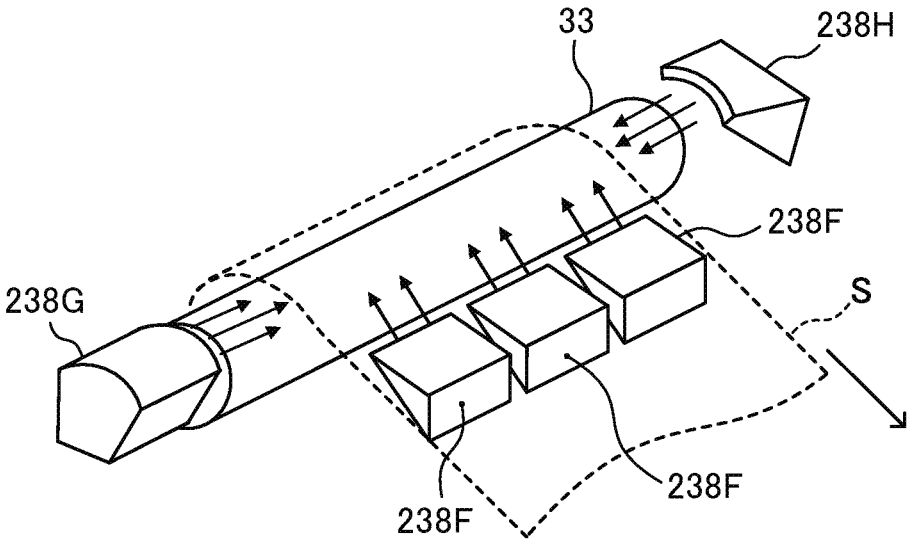
FIG. 15 is a schematic view of yet another example of the air supply device according to Variation 2.

FIG. 15 is a schematic view of yet another example of the air supply device according to Variation 2.

In the example illustrated in FIG. 15, air supply devices 238F are disposed downstream from the second driven roller 33 in the sheet conveyance direction, and air supply devices 238G and 238H are disposed outward the second driven roller 33 in the axial direction thereof. In this configuration, the air supply devices 238F alone do not cause a flow rate difference in the sheet width direction. However, by introducing air from the air supply devices 238G and 238H, the air flow rate in the center area A of the sheet S in the sheet width direction is reduced from the air flow rate in the end areas B in the sheet width direction. Also in this configuration, the meandering and deviation of the sheet S are autonomously suppressed by the internal pressure difference.

Figure 16:
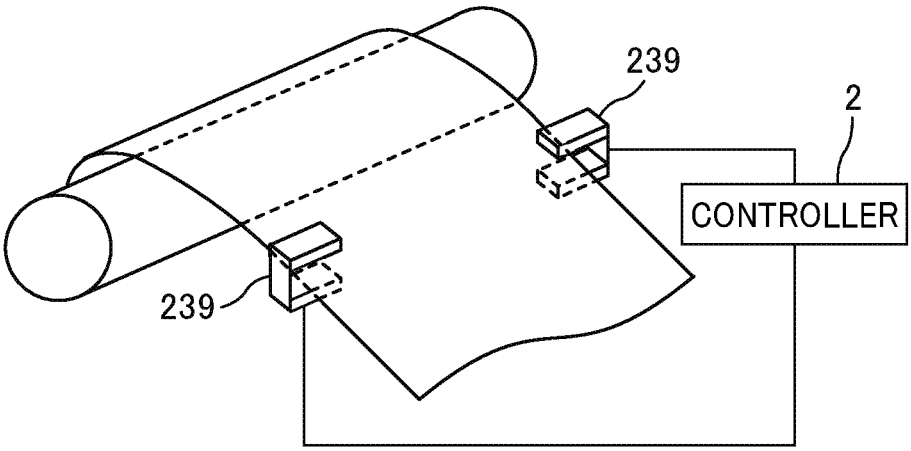
FIG. 16 is a schematic view illustrating edge sensors to detect ends of the sheet in the sheet width direction, according to an embodiment.

In the above-described examples according to Variation 2, the meandering and the deviation of the sheet S are autonomously suppressed. However, alternatively, the controller 2 can control the air supply device in accordance with the result of detection of the meandering and the deviation of the sheet S. In this case, for example, as illustrated in FIG. 16, edge sensors 239 to detect the end positions of the sheet S are disposed on the end sides of the support in the width direction. The controller 2 causes the air supply device to generate a flow rate difference in the sheet width direction in response to the detection result generated by the edge sensors 239, so that the force in the direction to cancel the deviation acts on the sheet S.

Effects of controlling air supply device to generate a flow rate difference in the sheet width direction are not limited to correction of the meandering and deviation of the sheet S. For example, the sheet S can be conveyed while being aligned with one side in the sheet width direction or being intentionally caused to meander.

In the above-described embodiment (including the variations and modifications), an inkjet recording apparatus employs a conveyance device (the sheet conveyance device 3) that conveys the sheet S by introducing a fluid (air) for forming a fluid layer between the roller face (or the face of the conveyance guide) and the sheet S. However, such a conveyance device can be widely provided for other apparatuses.

Figure 17:
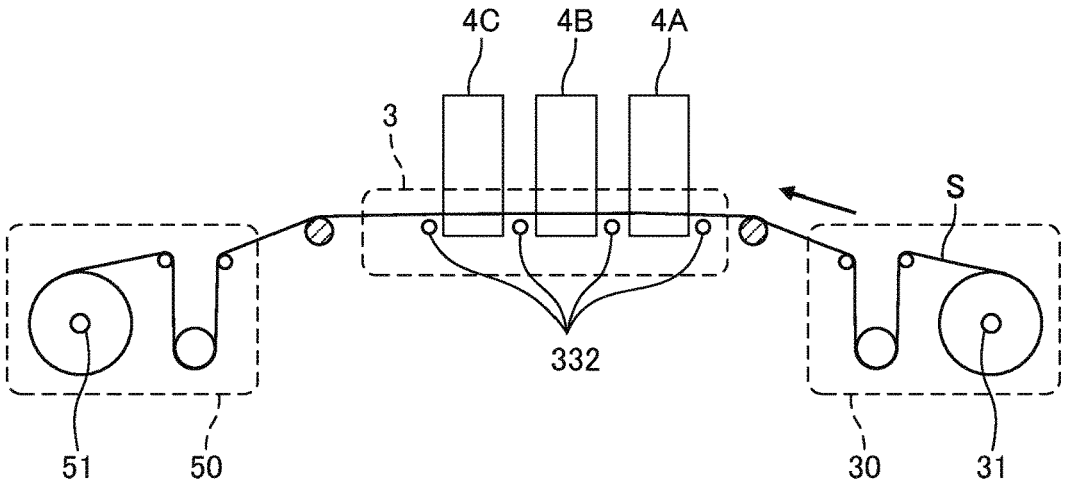
FIG. 17 is a schematic diagram illustrating a configuration in which a sheet wound in a roll shape on a feed spool of a sheet feeder is taken up by a take-up spool of a winder through a sheet conveyance device.

For example, as illustrated in FIG. 17, such a conveyance device is suitably applicable to a configuration in which a sheet wound in a roll shape on the feed spool 31 of a sheet feeder 30 is taken up by a take-up spool 51 of a sheet winder 50 through the sheet conveyance device 3. In FIG. 17, image forming devices 4A, 4B, and 4C are disposed side by side in the conveyance direction. There is no particular limitation on the content of the processing performed on the sheet S conveyed in the sheet conveyance device 3 that introduces a fluid (air) for forming a fluid layer between the roller face (or the face of the conveyance guide) and the sheet S, to convey the sheet S. However, aspects of the present disclosure are particularly effective in processing that is effectively performed with the sheet S kept contactless with the roller face (or the surface of the conveyance guide) and processing that requires high positional accuracy of the sheet S.

Figure 18:
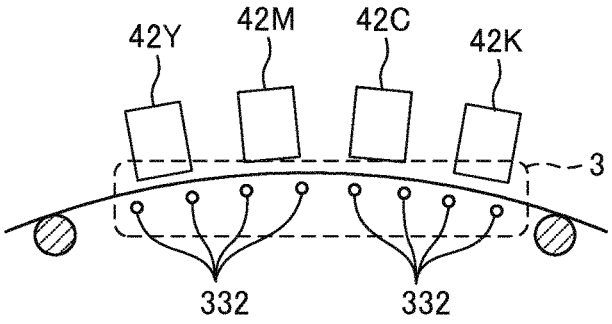
FIG. 18 is a schematic diagram illustrating an inkjet recording apparatus including liquid discharge heads for different colors, arranged in the sheet conveyance direction, according to an embodiment.

For example, as illustrated in FIG. 18, in an inkjet recording apparatus including liquid discharge heads 42Y, 42M, 42C, and 42K of different colors arranged in the sheet conveyance direction, high positional accuracy of the sheet S is required. Therefore, the sheet conveyance device 3 according to any of the above-described embodiment and variations is also effective for such an inkjet recording apparatus. In addition, since the deviation in landing position of the liquid discharged from the liquid discharge heads 42Y, 42M, 42C, and 42K needs to be suppressed with high accuracy, the configuration for suppressing the meandering and deviation of the sheet S as in the above-described Variation 2 is particularly effective.

Figure 19:
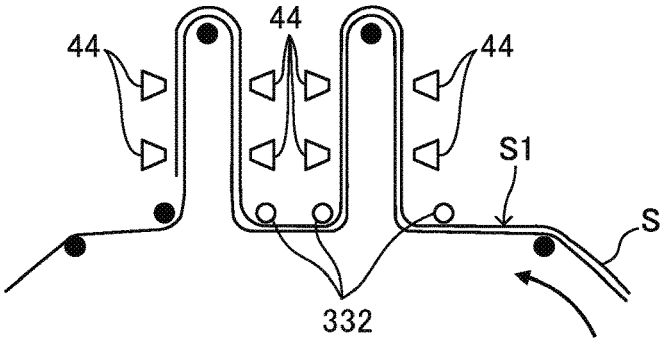
FIG. 19 is a schematic diagram illustrating a configuration including a drying device to dry an image formed on a sheet with ink, according to an embodiment.

The sheet conveyance device 3 according to any of the above-described embodiment and variations is also effective for, for example, drying devices 44 that dry an image formed with ink on a surface Si of the sheet S as illustrated in FIG. 19. In a drying process performed by the drying devices 44, it is effective to keep the surfaces of rollers 332 (or the surface of the conveyance guide) contactless with the surface Si on which the adhering ink is undried. In addition, when the sheet S is conveyed over a long distance as illustrated in FIG. 19, the meandering and deviation of the belt are likely to occur. Therefore, the configuration for suppressing the meandering and deviation of the sheet S as in the above-described Variation 2 is particularly effective.

The above description concerns configurations in which the support supports the back side of the sheet S opposite the image side bearing the image formed by discharged ink. However, aspects of the present disclosure are applicable to a configuration in which the support supports the image side of the sheet S. For example, aspects of the present disclosure are applicable to a portion around the tension roller 35 in the configuration illustrated in FIG. 1. That is, no fluid opening is formed on the surface of the tension roller 35, and air for forming an air layer between the roller face and the sheet S is introduced from outside the tension roller 35. The surface of the tension roller 35 faces the image side bearing an image formed by the ink discharged by the image forming device 4. Accordingly, the image is rubbed when the image side of the sheet S contacts the surface of the tension roller 35. Forming an air layer between the surface of the tension roller 35 and the sheet S can prevent rubbing of the image.

Since the rubbing of the image can be inhibited in this manner, the support that supports the sheet S after the image formation can be disposed so as to face the image side of the sheet S. As a result, the sheet conveyance passage can be designed to convey the sheet S while folding the sheet S in a limited space. Then, the apparatus can be compact and advantageous for drying ink. Further, since the rubbing of the image can be prevented, the degree of freedom of the conveyance passage when forming images on both sides of the sheet S is increased. Then, a compact apparatus is capable of double-sided image formation.

The above description concerns the conveyance device that conveys the sheet S on which an image is formed by discharged ink. However, the conveyance device is not limited to such a conveyance device that conveys the sheet S on which an image is formed. Aspects of the present disclosure can be applied to any conveyance device that conveys a conveyed object while supporting the conveyed object with a support.

The structures described above are examples, and aspects of the present disclosure provide respective effects as follows.

First Aspect

A first aspect concerns a conveyance device (for example, the sheet conveyance device 3) that conveys a conveyed object (for example, the sheet S) while floating the conveyed object. The conveyance device includes a support (for example, the first driven roller 32, the second driven roller 33, and the conveyance guide 133) having a support face configured to support the conveyed object. The conveyance device further includes a fluid introduction device (for example, the air supply devices 37, 38, and 138) to introduce, from outside the support, a fluid (for example, air) for forming a fluid layer (for example, an air layer) between the support face of the support and the conveyed object.

According to this aspect, the fluid for forming the fluid layer between the support face and the conveyed object is introduced from outside the support. Thus, the fluid layer can be formed between the support face and the conveyed object without forming a fluid opening on the support face of the support. Accordingly, the fluid layer can be formed between the support and the conveyed object, without increasing the processing cost of the support.

Second Aspect

According to a second aspect, the conveyance device of the first aspect further includes a tension sensor (for example, a tension sensor 21) to detect a tension of the conveyed object, and control circuitry (for example, the controller 2) configured to control the fluid introduction device according to a detection result of the tension sensor.

According to this aspect, even if the tension of the conveyed object varies, the fluid can be supplied in an appropriate amount according to the tension at that time. As a result, the air layer can be formed stably, for example, even when the tension of the conveyed object increases. Also, the conveyed object can be prevented from fluttering due to the supplied fluid, for example, even when the tension of the conveyed object decreases.

Third Aspect

According to a third aspect, the conveyance device of the first or second aspect further includes a behavior detector (for example, the displacement sensor 22) to detect a behavior of the conveyed object and control circuitry (for example, the controller 2) configured to control the fluid introduction device in accordance with a detection result of the behavior detector.

According to this aspect, even when the conveyed object flutters due to excessive or insufficient fluid supply, an appropriate amount of fluid can be supplied, and the conveyed object can be prevented from fluttering.

Fourth Aspect

According to a fourth aspect, the conveyance device of any one of the first to third aspects further includes an outflow stopper (for example, the outflow stopper plates 39 and 139) disposed at an end of the support in a width direction of the conveyed object, to inhibit the outflow of the fluid introduced between the support face and the conveyed object. The outflow stopper is configured to inhibit the fluid from flowing out in the width direction. This aspect inhibits the fluid introduced between the support face and the conveyed object from escaping from therebetween, and the air layer can be formed more stably.

Fifth Aspect

According to a fifth aspect, in any one of the first to fourth aspects, the support is a driven rotator (for example, the first driven roller 32 and the second driven roller 33) that is driven to rotate along with the conveyance of the conveyed object.

According to this aspect, even when the fluid layer between the support face and the conveyed object collapses and the conveyed object contacts the support face, the driven rotator is rotated (driven to rotate), which can avoid a sharp increase in the resistance against the conveyance.

Sixth Aspect

According to a sixth aspect, in the fifth aspect, the center of gravity of the driven rotator is off the center of rotation of the driven rotator.

According to this aspect, rotation of the driven rotator that has been rotated can be stopped at an early stage, thereby shortening the period in which the conveyed object flutters due to the rotational runout of the driven rotator.

Seventh Aspect

According to a seventh aspect, in any one of the first to fourth aspects, the support is an irrotational body.

This aspect is more advantageous in the degree of freedom of layout and space saving than in a case where the support is a rotator.

Eighth Aspect

According to an eighth aspect, in any one of the first to seventh aspects, the fluid introduction device introduces the fluid toward the support in a direction perpendicular to the conveyance direction of the conveyed object.

This aspect can increase the degree of freedom in the layout of the fluid introduction device.

Ninth Aspect

In a ninth aspect, in any one of the first to eighth aspects, the fluid introduction device is configured to introduce the fluid in a smaller flow rate in a center area of the conveyed object in a width direction perpendicular to a conveyance direction of the conveyed object than a flow rate in an end area of the conveyed object in the width direction.

According to this aspect, the flow rate in the center area in the width direction perpendicular to the conveyance direction of the conveyed object is smaller than the flow rate in the end area. Accordingly, in the fluid layer between the conveyed object and the support face of the support, an internal pressure can be made different between the center area and the end area in the width direction. This configuration causes force directing from the end area of the conveyed object toward the center in the width direction. Accordingly, the meandering and deviation of the conveyed object can be suppressed.

Tenth Aspect

A tenth aspect provides a liquid discharge apparatus (for example, the inkjet recording apparatus 1) that discharges a liquid (for example, ink) onto a conveyed object (for example, the sheet S) conveyed by the conveyance device according to any one of the first to ninth aspects.

According to this aspect, since the fluid layer can be formed between the support face and the conveyed object, the liquid discharge apparatus can discharge the liquid to the conveyed object that is inhibited from fluttering. Accordingly, an inexpensive liquid discharge apparatus having a high liquid landing accuracy can be provided.

Eleventh Aspect

According to an eleventh aspect, in the tenth aspect, the support face of the support is opposite a liquid adhering surface (for example, an image side of a medium) of the conveyed object to which the liquid has adhered.

According to this aspect, the support is disposed such that the support face is opposed, via the fluid layer, to the liquid adhering surface of the conveyed object to which the liquid is applied. Accordingly, the fluid layer can prevent the support face from rubbing the liquid on the conveyed object. Therefore, such an arrangement of the support does not cause a problem, and the degree of freedom of the layout of the conveyance passage is increased.

The above-described embodiments are illustrative and do not limit the present disclosure. Thus, numerous additional modifications and variations are possible in light of the above teachings. For example, elements and/or features of different illustrative embodiments may be combined with each other and/or substituted for each other within the scope of the present disclosure.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA) and conventional circuit components arranged to perform the recited functions.

What is claimed is:

1. A conveyance device comprising:

a support having a support face configured to support a conveyed object;

a fluid introduction device being outside the support, the fluid introduction device configured to introduce a fluid between the support face of the support and the conveyed object, to form a fluid layer for floating the conveyed object; and a conveyor configured to convey the conveyed object being floating from the support via the fluid layer.

2. The conveyance device according to claim 1, further comprising:

a tension sensor configured to detect a tension of the conveyed object; and control circuitry configured to control the fluid introduction device according to a detection result of the tension sensor.

3. The conveyance device according to claim 1, further comprising:

a behavior detector configured to detect a behavior of the conveyed object; and control circuitry configured to control the fluid introduction device according to a detection result of the behavior detector.

4. The conveyance device according to claim 1, further comprising:

an outflow stopper at an end of the support in a width direction perpendicular to a conveyance direction of the conveyed object, the outflow stopper configured to prevent the fluid from flowing out from between the support face and the conveyed object in the width direction.

5. The conveyance device according to claim 1, wherein the support is a driven rotator configured to rotate along with conveyance of the conveyed object.

6. The conveyance device according to claim 5, wherein the center of gravity of the driven rotator is off a center of rotation of the driven rotator.

7. The conveyance device according to claim 1, wherein the support is an irrotational body.

8. The conveyance device according to claim 1, wherein the fluid introduction device is outside the support in a width direction perpendicular to a conveyance direction of the conveyed object, and wherein the fluid introduction device is configured to introduce the fluid toward the support in the width direction.

9. The conveyance device according to claim 1, wherein the fluid introduction device is configured to introduce the fluid in a smaller flow rate in a center area of the conveyed object in a width direction perpendicular to a conveyance direction of the conveyed object than a flow rate in an end area of the conveyed object in the width direction.

10. A liquid discharge apparatus comprising:

the conveyance device according to claim 1; and a liquid discharge device configured to discharge a liquid onto the conveyed object conveyed by the conveyance device.

11. The liquid discharge apparatus according to claim 10, wherein the support face of the support is opposite a liquid adhering surface of the conveyed object to which the liquid is applied by the liquid discharge device.

* * * * *